US007743700B2

(12) United States Patent
Ayala et al.

(10) Patent No.: US 7,743,700 B2
(45) Date of Patent: Jun. 29, 2010

(54) ROLLER DIE PRESS

(75) Inventors: Gerry Ayala, Provo, UT (US); Michael Horito, Provo, UT (US); Tyler Allan, Springville, UT (US)

(73) Assignee: Provo Craft and Novelry, Inc., Spanish Fork, UT (US)

( * ) Notice: Subject to any disclaimer, the term of this patent is extended or adjusted under 35 U.S.C. 154(b) by 258 days.

(21) Appl. No.: 11/669,088

(22) Filed: Jan. 30, 2007

(65) Prior Publication Data

US 2007/0214972 A1 Sep. 20, 2007

Related U.S. Application Data

(60) Provisional application No. 60/763,471, filed on Jan. 30, 2006.

(51) Int. Cl.
*B30B 3/04* (2006.01)

(52) U.S. Cl. ..... 100/176; 100/282; 248/362; 248/363

(58) Field of Classification Search ..... 100/76, 100/121, 155 R, 172, 173, 176, 280, 282, 100/288, 292; 68/97, 98, 99, 244; 248/362, 248/363

See application file for complete search history.

(56) References Cited

U.S. PATENT DOCUMENTS

| | | | | |
|---|---|---|---|---|
| 142,648 | A | 9/1873 | Peterson | |
| 756,902 | A | 4/1904 | Shoemaker | |
| 896,478 | A | 8/1908 | Stockman | |
| 1,453,405 | A | 5/1923 | Platt | |
| 1,523,736 | A | 1/1925 | Wagner | |
| 1,658,823 | A | 2/1928 | Willard | |
| 1,992,250 | A | 2/1935 | Stacey | |
| 2,005,340 | A | 6/1935 | Jaffin | |
| 2,019,009 | A | 10/1935 | Hendrix | |
| 2,029,567 | A | 2/1936 | Hough | |
| 2,068,707 | A | 1/1937 | Reardon | |
| 2,112,011 | A | 3/1938 | Byerlein | |
| 2,245,770 | A | 6/1941 | Franzmann | |
| 2,260,183 | A | 10/1941 | Leslie | |
| 2,458,867 | A | 1/1949 | Messersmith | |
| 2,570,820 | A * | 10/1951 | Knab | 378/153 |
| 2,595,970 | A | 5/1952 | McGill | |
| 2,612,123 | A | 9/1952 | Nord | |
| 2,619,173 | A | 11/1952 | Crain | |
| 2,625,908 | A | 1/1953 | Knott | |
| 2,641,781 | A | 6/1953 | Haskell | |
| 2,703,023 | A | 3/1955 | Sarno | |

(Continued)

FOREIGN PATENT DOCUMENTS

| | | |
|---|---|---|
| JP | 04-217497 | 8/1992 |

(Continued)

*Primary Examiner*—Jimmy T Nguyen
(74) *Attorney, Agent, or Firm*—Honigman Miller Schwartz and Cohn LLP

(57) ABSTRACT

A roller press includes a housing to which upper and lower rollers are coupled. A crank handle is coupled to at least one of the upper and lower rollers. Rotation of the crank handle causes rotation of the rollers. Two doors that provide die support surfaces are coupled to the housing and are moveable between a closed position and an open position. A suction member is coupled to the bottom of the housing. The suction member is actuated by movement of the doors.

7 Claims, 8 Drawing Sheets

U.S. PATENT DOCUMENTS 2,791,029 A 5/1957 Leo
2,821,871 A 2/1958 Sarno
2,876,575 A 3/1959 Leika
2,885,933 A 5/1959 Phillips
2,994,265 A 8/1961 Hurlbut et al.
3,064,559 A 11/1962 Treer
3,094,091 A 6/1963 Peccerill
3,170,358 A 2/1965 Martin
3,182,530 A 5/1965 Scott et al.
3,213,737 A 10/1965 Wright
3,228,263 A 1/1966 Bien
3,250,163 A 5/1966 Smith
3,261,044 A 7/1966 Hoff
3,264,978 A 8/1966 Staley
3,266,358 A 8/1966 Cox et al.
3,383,969 A 5/1968 Saunders
D211,608 S 7/1968 Gray
3,400,625 A 9/1968 Wrona
3,531,863 A 10/1970 Sandborn
3,534,440 A 10/1970 Roberts
3,570,341 A 3/1971 Abbott
3,581,617 A 6/1971 Lysobey
3,587,382 A 6/1971 Boyd
3,667,334 A 6/1972 Brunett
3,744,384 A 7/1973 Jarritt et al.
3,863,550 A 2/1975 Sarka et al.
3,926,032 A 12/1975 Brooks et al.
3,935,811 A 2/1976 Lenz et al.
3,986,447 A 10/1976 Zimmer
4,052,886 A 10/1977 Buick
4,065,990 A 1/1978 Edhlund
D257,777 S 1/1981 Eichenberg et al.
4,345,516 A 8/1982 Sinclair
4,416,200 A 11/1983 Yon
4,444,075 A 4/1984 Mulry
4,462,291 A 7/1984 Schulz
4,537,546 A 8/1985 Lucas
4,542,691 A 9/1985 Kokrhanek
4,625,592 A 12/1986 Bayens
4,638,731 A 1/1987 Kato
4,662,413 A 5/1987 Bater
4,692,198 A 9/1987 Borresen
D296,565 S 7/1988 Eichenberg et al.
4,761,988 A 8/1988 Kato
4,763,551 A 8/1988 Halff et al.
4,818,207 A 4/1989 Heron
4,979,613 A 12/1990 McLaughlin et al.
4,981,061 A 1/1991 Hillock et al.
5,042,379 A 8/1991 Greer
D319,771 S 9/1991 Reid et al.
5,054,389 A 10/1991 Kuhlman et al.
5,112,423 A 5/1992 Liebe, Jr.
5,129,157 A 7/1992 Wood
5,135,533 A 8/1992 Peterson et al.
5,140,872 A 8/1992 Holliday et al.
5,172,622 A 12/1992 Sabin
5,181,464 A 1/1993 Kuhlman et al.
5,188,026 A 2/1993 Fuqua et al.
5,230,156 A 7/1993 Patenaude
5,255,587 A 10/1993 Eichenberg et al.
D341,842 S 11/1993 Eichenberg et al.
5,275,076 A 1/1994 Greenwalt
5,368,672 A 11/1994 Gunzelman et al.
5,383,996 A 1/1995 Dressler
D359,967 S 7/1995 Eichenberg et al.
5,544,576 A 8/1996 Kato
5,579,582 A 12/1996 Carlson
5,590,910 A 1/1997 Meth
5,628,226 A 5/1997 Weissman
D380,488 S 7/1997 Elstad et al.
5,647,260 A * 7/1997 Nabity ..... 83/522.12
5,660,105 A 8/1997 Benson et al.
D384,572 S 10/1997 Ongaro
5,685,213 A 11/1997 Görl et al.
5,722,319 A 3/1998 Hirano
5,775,213 A 7/1998 Hyde
5,778,748 A 7/1998 Beijen
5,961,779 A * 10/1999 Bradshaw ..... 156/495
6,170,376 B1 1/2001 Strobel et al.
6,220,136 B1 4/2001 Benes et al.
6,543,131 B1 4/2003 Beroz et al.
6,619,195 B2 9/2003 Corcoran et al.
6,626,965 B2 9/2003 Workman et al.
6,658,978 B1 12/2003 Johnson
6,739,244 B1 5/2004 Carbaugh
7,004,056 B2 2/2006 Shorter et al.
7,335,009 B2 * 2/2008 Lee ..... 425/298
2003/0019370 A1 1/2003 Corcoran et al.
2004/0118304 A1 6/2004 Corcoran et al.
2005/0028644 A1 2/2005 Hughes
2005/0034785 A1 * 2/2005 Lovchik et al. ..... 144/356
2005/0045522 A1 3/2005 Corcoran
2005/0050936 A1 3/2005 Hughes et al.
2005/0056166 A1 3/2005 Corcoran et al.
2005/0061168 A1 3/2005 Corcoran et al.
2005/0211041 A1 9/2005 Oh
2005/0215405 A1 9/2005 Corcoran
2005/0253324 A1 11/2005 Corcoran et al.
2005/0268761 A1 12/2005 Corcoran et al.
2006/0032385 A1 2/2006 Corcoran et al.

FOREIGN PATENT DOCUMENTS

JP 11-034184 2/1999
JP 2000-127095 5/2000
WO WO 03/016035 2/2003

* cited by examiner

ROLLER DIE PRESS

CROSS-REFERENCE TO RELATED APPLICATIONS

This application claims the benefit of U.S. Provisional Application No. 60/763,471, filed Jan. 30, 2006, entitled ROLLER DIE PRESS, which is hereby incorporated herein by reference in its entirety.

BACKGROUND OF THE INVENTION

1. Field of the Invention

The present invention relates generally to die presses used with dies for forming paper cut out patters, and more particular to a roller-type die machine.

2. Description of the Prior Art

Die cuts are preformed pieces of paper or other die cuttable materials that are cut into a desired shape. For example, die cuts are often available in various shapes such as teddy bears, hearts, stars, etc. Multiple die cuts are usually packaged together for consumer purchase and may include die cuts formed from various colors of paper.

The die cuts are formed by pressing a blade, which has been formed into the desired shape, against a sheet of paper or any other cuttable material to cut or punch out a section of the paper or other material corresponding to the shape of the blade. Traditionally, the blade was partially embedded in a block of wood, the blade/block apparatus commonly referred to as a "die." Later, systems for holding the blade in a block of plastic were developed such as described in U.S. Pat. No. 6,626,965, incorporated herein by this reference. Subsequently, other die making technologies have been developed such as dies manufactured by chemical etching processes.

With each type of die has generally come a new type of machine for pressing the die against the medium to be cut. For example, when the plastic dies previously discussed were first introduced, the corresponding machine employed a lever mechanism to impart sufficient pressure against the die so as to press the blade of the die through the paper to be cut. In general, such machines were relatively bulky. As the dies became thinner and thus more compact, more compact machines were also developed. In particular, with the use of chemical etched dies, a roller-type machine was developed in which the die and paper to be cut were pulled between a pair of rollers operated by a crank handle. The roller-type machines were generally more compact than the previous lever-type machines since they did not require the use of a platen that was at least the size of the die being used for cutting. A typical roller press is disclosed in U.S. patent application Ser. No. 11/127,434, Publication No. US20050253324A1, herein incorporated by this reference.

Because of the large footprint of the lever-type systems, such machines did not typically require a mechanism for securing the machine to a work surface. Moreover, such machines maintained support of the die and medium being cut throughout the cutting process. Conversely, the smaller crank operated machines are less stable, given their relatively smaller footprint when operating the machine. As such, there is typically a need for a mechanism for holding the machine to a work surface. In addition, because the machines were made to be more compact, the machines do not laterally support for the die and medium during the cutting process.

Thus, it would be advantageous to provide a die cutting machine that is easy to operate, laterally supports the die and medium while cutting manufacture, and is easily secured to a work surface during operation.

These and other advantages will become apparent from a reading of the following summary of the invention and description of the preferred embodiments in accordance with the principles of the present invention.

SUMMARY OF THE INVENTION

Accordingly, a portable roller press is provided with a mechanism that secures the roller press to a work surface to stabilize the press during operation.

In one embodiment of the invention, the portable roller press is provided with fold-out support platforms that provide a support surface for a die and medium being cut with the press. The fold-out support platforms are moveable between a first closed position and a second open position. In the second open position, the support platforms extend laterally relative to the roller mechanism for supporting a die and medium being cut, both as the die is fed into the machine and as the die exits the machine.

In another embodiment of the invention, when the fold-out support platforms are pivoted from a first closed position to a second open position, the support platforms actuate a suction base that secures the roller press to a work surface. When the support platforms are returned to a closed position, the suction base is deactivated so as to release the suction base from the support surface. The support platforms are thus interconnected to a mechanism for actuating a suction base.

These and other features, objects, and advantages of embodiments of the present invention will become more apparent from the detailed description set forth below when taken in conjunction with the drawings, in which like elements bear like reference numerals.

DETAILED DESCRIPTION OF THE ILLUSTRATED EMBODIMENTS

Figure 1A:
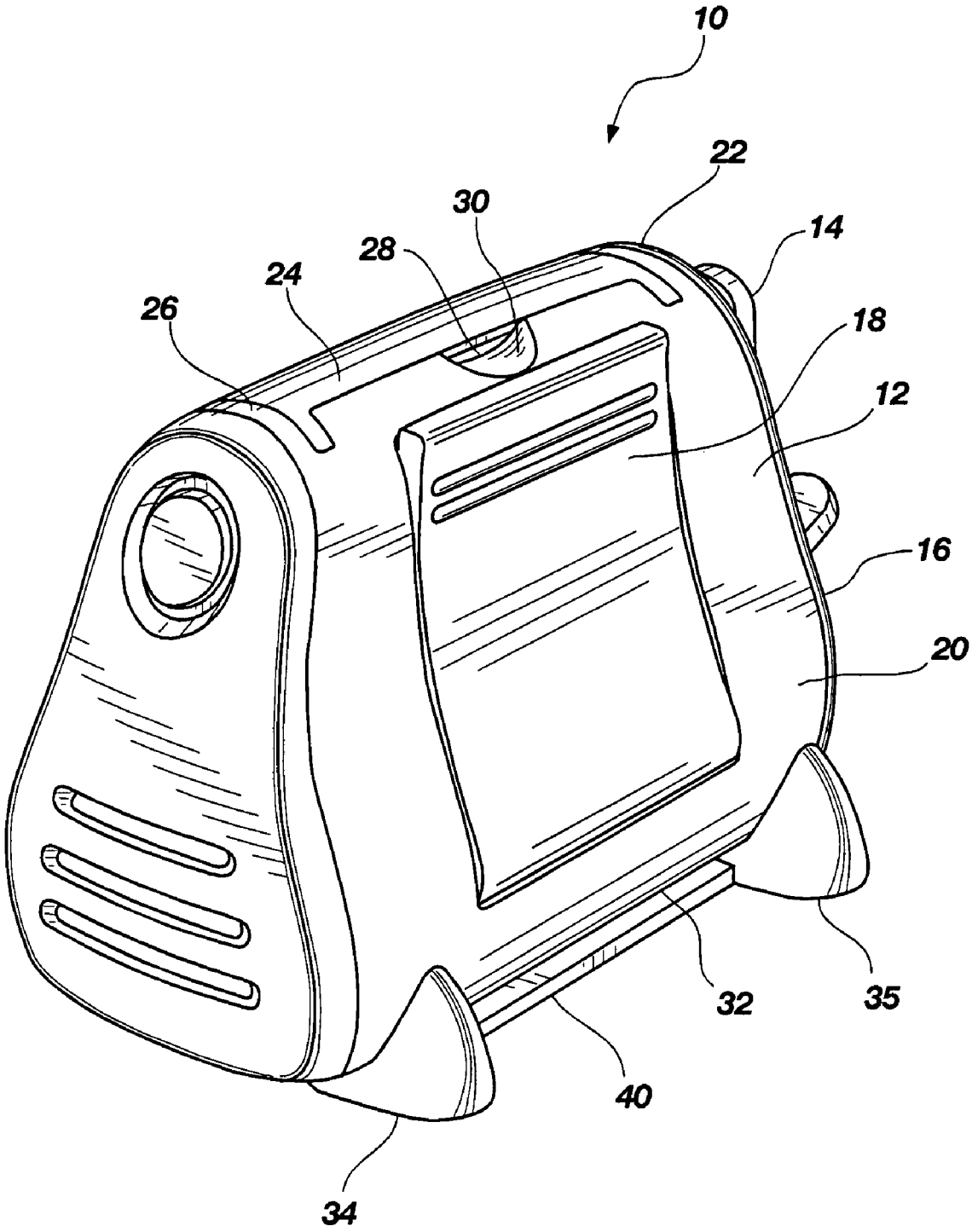
FIG. 1A is a perspective side view of a roller press in accordance with the principles of the present invention.

FIG. 1A is a perspective side view of a first embodiment of a roller-type die press, generally indicated at 10 for use with paper cutting dies, such as the types of cutting dies for cutting paper or other materials in sheet form known in the art (e.g., SIZZIX brand dies and SIZZLET brand dies). The die press 10 is comprised of a housing body 12 having a generally tear-drop shape. A crank handle 14 is provided on one end 16 of the die press 10 for turning cylindrically shaped rollers (described below). A pair of doors, only door 18 of which is visible in FIG. 1, are provided on either side 20 and 22 of the die press 10. A carry handle 24 is provided along the top 26 of the die press 10. The handle 24 is integrated into the top 26 of the die press 10 and retracts into a recess 28 when not in use. A pair of cut outs 30 is provided in the top 26 of the die press 10 for grasping the handle 24 and lifting the handle 24 relative to the top 26.

Figure 1B:
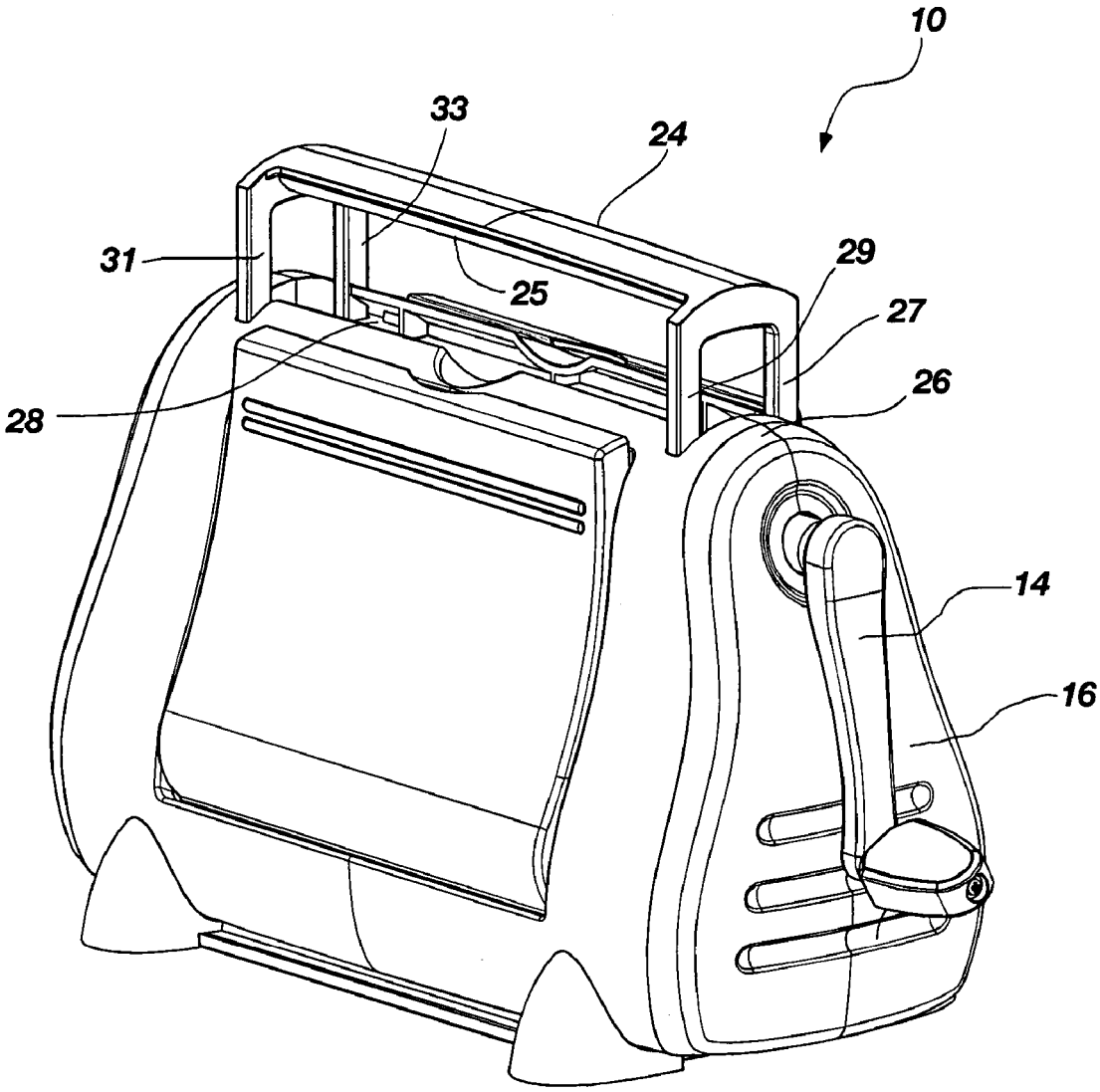
FIG. 1B is a perspective side view of the roller press shown in FIG. 1A with the handle extended.

As shown in FIG. 1B, the handle 24 can be lifted from the top 26 of the die press 10 for grasping by a user and carrying the die press 10. The handle 24, which normally resides in the recess 28 in the top 26 of the die press housing body 12, has a curved underside 25 to provide a comfortable gripping surface when carrying the die press 10. The handle 24 is coupled to the housing body 12 with vertical support members 27, 29, 31 and 33 that slide relative to the housing body 12 when being retracted or extended relative to the top 26 of the die press 10. Proximate the distal ends (not visible) of the support members 27, 29, 31 and 33, are abutment stops (not visible) that provide abutments between the handle 24 and the housing body 12 so that the handle 24 can only be extended a predetermined distance relative to the housing body 12.

Referring again to FIG. 1A, at the bottom 32 of the die press 10 are foot members, only foot members 34 and 35 of which are visible, positioned proximate the four corners of the die press 10 for stabilizing the die press 10 when being used. A suction member 40 is also provided at the bottom 32 of the die press 10. The suction member 40 is capable of providing a vacuum between the bottom surface of the suction member 40 and a smooth surface upon which the die press is resting (i.e., a work surface).

Figure 2:
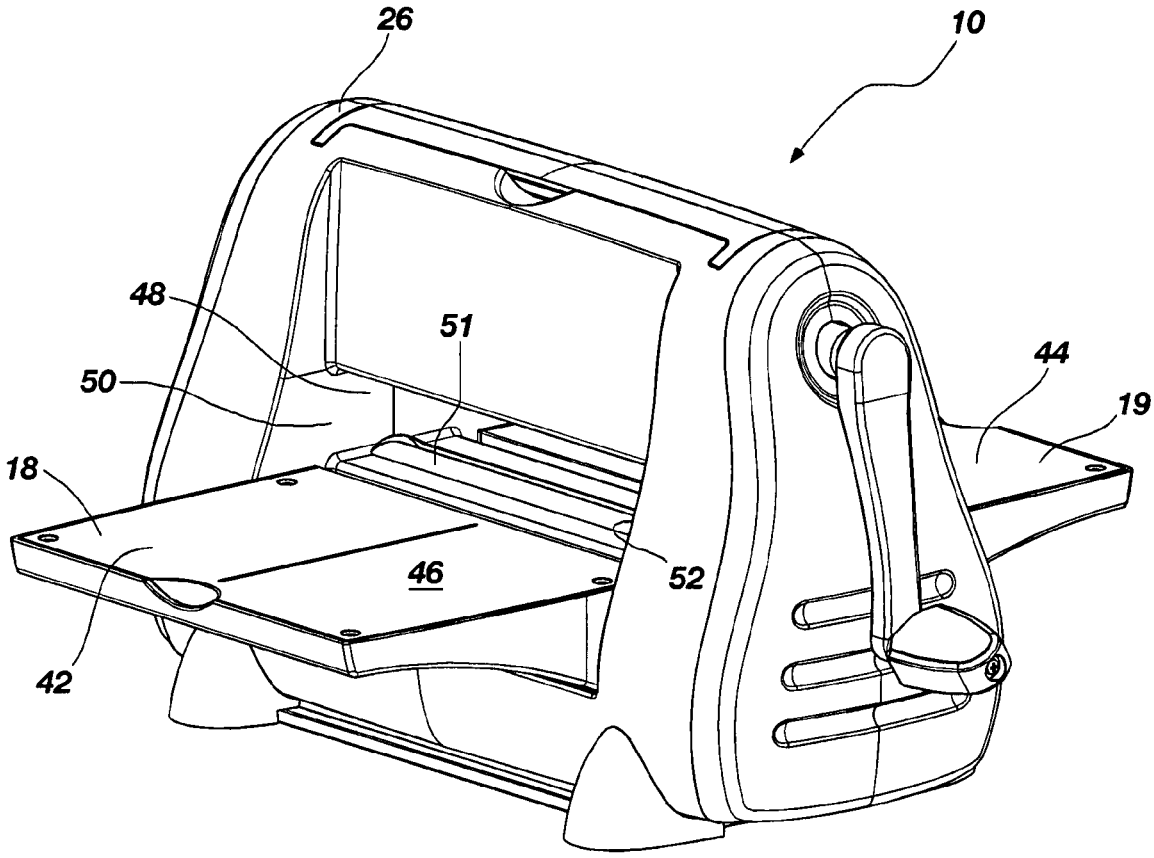
FIG. 2 is a perspective side view of the roller press shown in FIG. 1A with the doors extended.

Referring now to FIG. 2, the die press 10 is shown in an open position, as compared to the closed position illustrated in FIG. 1A. The doors 18 and 19 are configured to lie in substantially planar relationship to one another when fully opened. In the open position, the doors 18 and 19 are pivoted outwardly from the top 26 of the die press 10. The inside surfaces 42 and 44 of the doors 18 and 19, respectively, form a planar support surface 46 that extends between the two doors 18 and 19. The planar surface 46 is provided for supporting a die and associated paper and cutting mat (not shown) that is fed into the opening 48 between the upper roller (not visible) and the lower roller 51 and continues to support the die and associated paper and cutting mat as they exit the opening 48 to glide along the surface 44 of door 19. The doors 18 and 19 fit within the mouth or throat of the die press 10 through which a die is fed. The inside side surfaces 50 and 52 of the die press 10 define the maximum width of die that can be inserted through the die press 10. In practice, the width of the die may be configured to substantially match the width of the mouth such that the inside surfaces 50 and 52 help to guide the sides of the die as it is pulled through the die press 10 to maintain linear movement of the die through the die press 10 without twisting.

Figure 3:
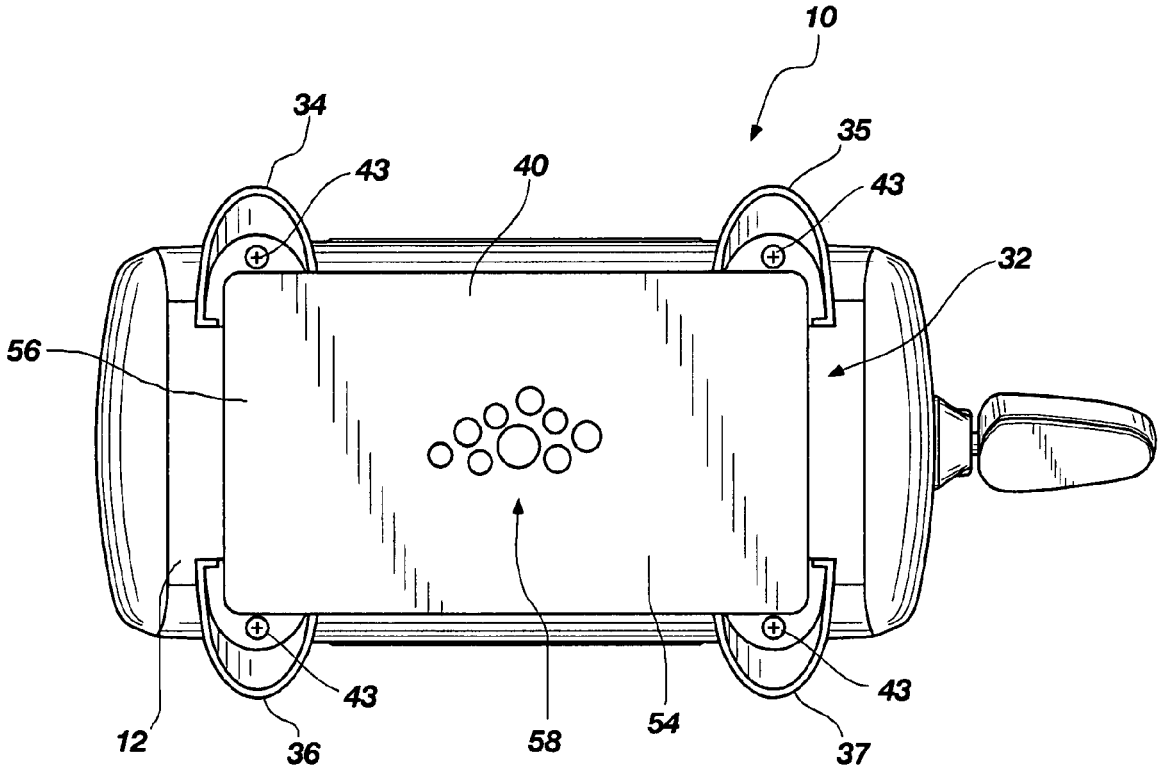
FIG. 3 is a bottom view of the roller press shown in FIG. 1.

Referring now to FIG. 3, the bottom 32 of the die press 10 is illustrated. The base of the die press 10 is stabilized by four foot members 34-37. The foot members 34-37 are attached to the bottom 32 of the housing body 12 by fasteners 43. The foot members 34-37 effectively increase the size of the base without requiring expansion of the size of the base of the housing body 12. As previously discussed, a suction member 40 is also provided at the base of the housing body 12. The suction member 40 is comprised of a flexible, relatively easily deformable, resilient material, such as a rubber-based compound. The suction member 40 is configured to create a vacuum between the bottom surface 54 of the suction member 40 and a relatively smooth surface (i.e., the work surface) upon which the suction member 40 is resting. When the center of the suction member 40 is lifted from a resting state to a vacuum drawing state and the perimeter surface 56 of the bottom surface 54 forms an air-tight seal between the bottom surface 54 and the work surface (not shown), a vacuum is formed between the bottom surface 54 and the support surface to hold the die press 10 in firm place when in use. A plurality of semi-spherical protrusions 58 are provided proximate the center of the bottom surface 54 of the suction member 40 for creating a small space between the center of the bottom surface 54 and the support surface so as to assist in perimeter contact of the bottom surface 54 with the support surface for forming an air-tight seal to the support surface. That is, when the bottom surface 54 of the suction member 40 is resting upon a flat work surface, the protrusions 58 cause a slight concavity to the bottom surface 54 such that the suction member 40 rests upon the perimeter surface 56. As such, when the center of the bottom surface 54 is raised by actuation of the suction mechanism, a substantially airtight seal between the work surface and the perimeter surface 56 is more easily formed.

Figure 4A:
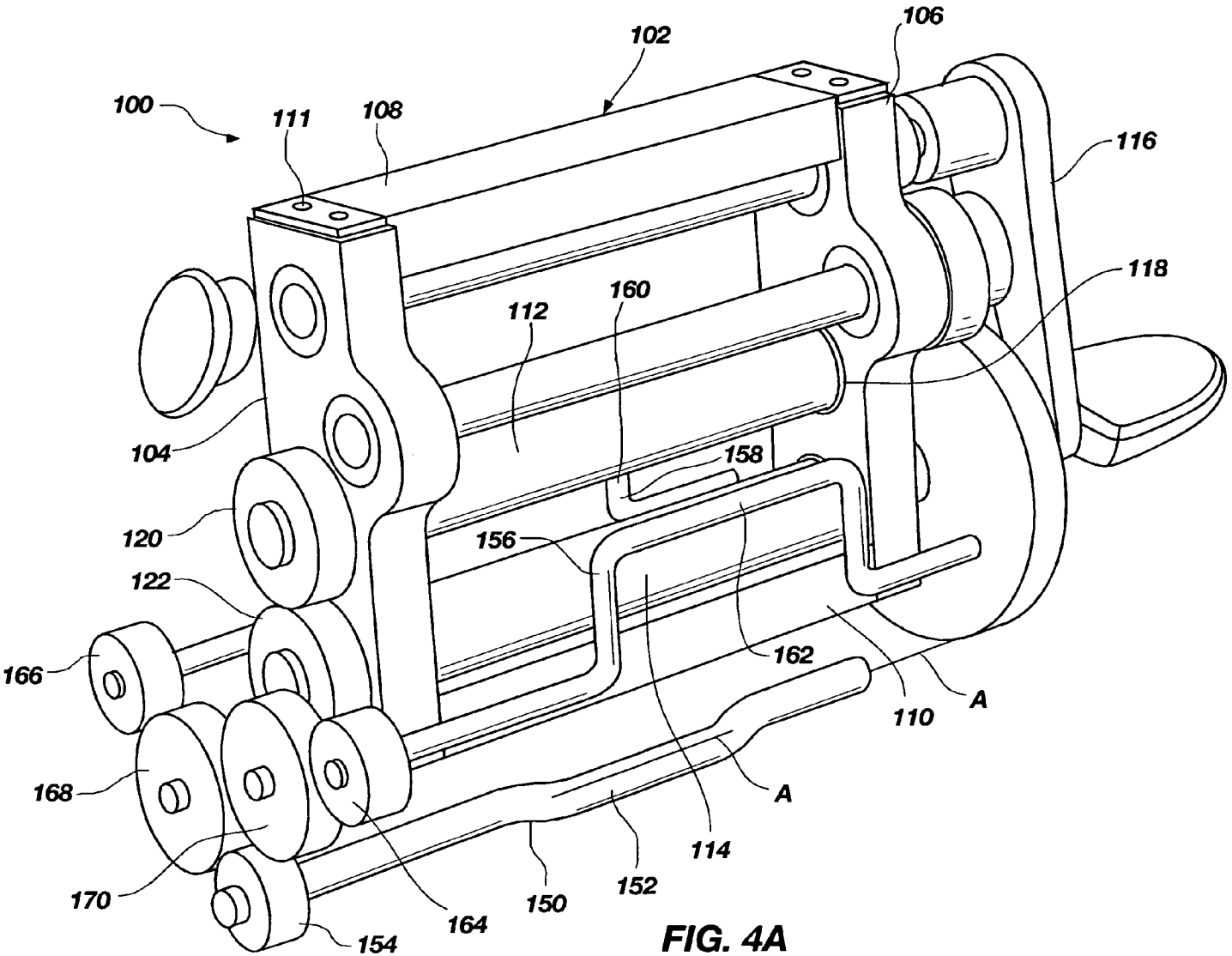
FIG. 4A is a perspective left side view of one embodiment of a roller assembly in accordance with the principles of the present invention.

Referring now to FIG. 4A, there is illustrated a left side perspective view of a first embodiment of a roller press mechanism, generally indicated at 100, in accordance with the principles of the present invention. The roller press mechanism 100 is configured to be housed within a roller press housing, such as the housing body 12 shown in FIG. 1A. The roller press mechanism 100 is comprised of a box-like support frame 102 that includes a pair of opposing upright side members 104 and 106 and lateral upper and lower support members 108 and 110. The frame members 104, 106, 108 and 110 are coupled together as with threaded fasteners 111. A pair of pressing rollers 112 and 114 is rotatably coupled to and between the left and right side members 104 and 106, respectively. The pressing rollers are driven through a series of intermeshing gears by rotation of the crank handle 116. Each end of each pressing roller 112 and 114 is coupled to the upright frame members 104 and 106 with bearings 118 that provide for free rotation of the rollers 112 and 114 relative to the frame members 104 and 106. The press rollers 112 and 114 are provided with gears 120 and 122 of equal size that mesh with each other to provide equal rotational speed of the two press rollers 112 and 114. This ensures that a die inserted between the rollers 112 and 114 is pulled on its top and bottom at the same speed through the roller press 100 to provide uniform cutting by the die press 100.

Figure 4B:
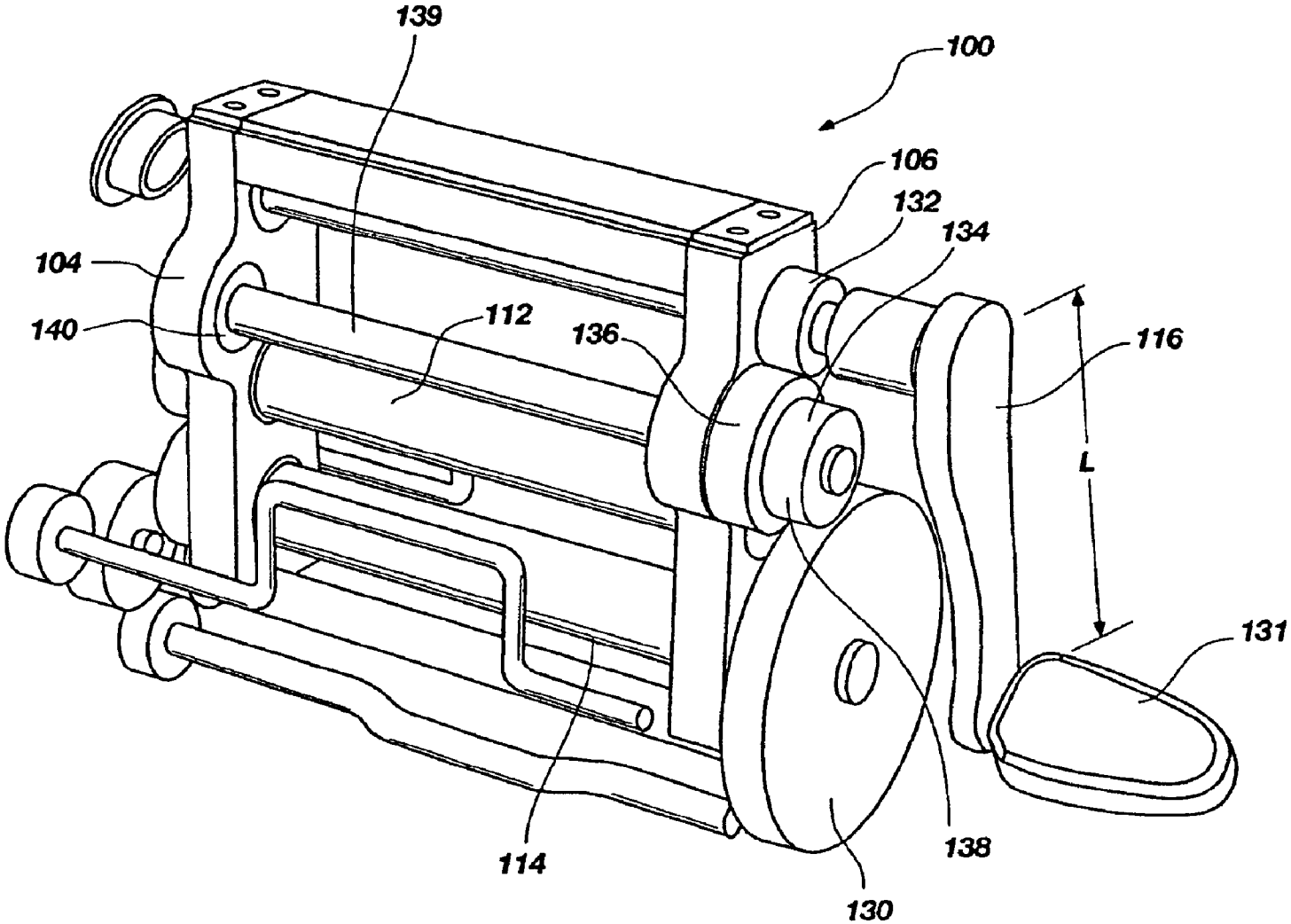
FIG. 4B is a perspective right side view of the roller assembly shown in FIG. 4A.

The rollers 112 and 114, as further illustrated in FIG. 4B (illustrating a right side perspective view of the roller press mechanism 100), the crank handle 116 includes a rotating grasping member 131 configured for grasping by the thumb and forefinger of a user to rotate the handle 116 relative to the roller press support frame 102. Because of the effective arm length L of the crank handle 116 necessary to allow the user to impart enough force to pull a die through the die press mechanism 100 a gearing ratio is employed to cause slower rotation of the press rollers 112 and 114 relative to the speed of rotation of the crank handle 116. That is, a gear 130 that is larger than the gear 132 coupled to the crank handle is coupled to the drive roller 114. The gearing ration may be as much as 4 or 5 to I or more such that the crank handle 116 must be rotated several times to cause a single rotation of the drive roller 114 and in tandem the upper roller 112. Of course, in order to change the ratio of rotation of the rollers 112 and 114 relative to the rotation of the crank handle 116, different sized gears having different gear ratios may be employed.

In addition, in order to allow clock-wise rotation of the crank handle 116 in order to drive the drive roller 114 and upper roller 112 in a direction that will pull a die through the rollers 112 and 114, an intermediate two-step gear 134 is engagedly interposed between the crank gear 132 and the drive gear 130. The prior art roller-type die presses require counter-clockwise rotation of the crank handle to impart proper rotation of the press rollers which is generally counter intuitive for right-handed users.

The two-step gear 134 has a larger diameter portion 136 that engages the crank gear 132 and a smaller diameter portion 138 that engages and drives the drive gear 130. The intermediate gear 134 thus further provides a gearing ratio between the crank gear 132 and the drive gear 130 to allow for a reduced size drive gear 130 than may otherwise be required if a direct gearing were provided between the crank gear 132 and the drive gear 130, as is the case in the prior art. Using a smaller gear for the drive gear 130 reduces material cost and expense of the drive gear 130. The intermediate gear 134 is freely rotatably coupled to the left and right frame members 104 and 106 with a support shaft 139 that is rotatably coupled to the frame members 104 and 106 with bearings 140. The shaft prevents cocking of the gear 134 when significant pressure is applied to the gear 134 by the crank gear 132.

Referring again to FIG. 4A, a particularly unique feature of the roller press 100 is illustrated. In order to actuate the suction mechanism, such as the suction mechanism illustrated in FIG. 3, a suction actuation member or shaft 150 is provided at the bottom of the roller press mechanism 100. The suction actuation shaft 150 has an offset portion 152 that is not in alignment with the longitudinal axis A of the shaft 150. The shaft 150 is rotated about the axis A by the gear 154. The offset portion 152 is illustrated in a down or resting position when no suction is being drawn by the suction mechanism. Upon rotation of the shaft 150 by approximately 180 degrees the offset portion 152 is in an up or engaged position. By coupling the center of the suction member to the offset portion 152, the center of the suction member is lifted relative to its perimeter upon rotation of the shaft 150 when the offset portion 152 is in the up position. When the center of the suction member is lifted, a vacuum is created between the suction member and a support surface to hold the suction member (and the shaft 150) thereto. As will be further described herein, because the housing of the die press is coupled to the suction member, the die press is held in place when suction to a support surface is achieved.

The rotation of the shaft 150 between a first resting position as shown and a second engaging position is actuated by movement of the doors (such as the doors 18 and 19 shown in FIG. 2). That is, door arm members 156 and 158 are rotatably coupled relative to housing body of the roller press and are pivoted in tandem, through gear interaction, by movement of the doors. When the doors are in an upright or closed position, the offset portions 160 and 162 of the arm member 156 and 158 are in a first upright position. When the doors are opened, the offset portions 160 and 162 are pivoted downwardly causing rotation of the corresponding arm gears 164 and 166, respectively. The arm gears 164 and 166 are engaged with idler gears 168 and 170, respectively, so that when one arm gear 164 rotates, the second arm gear 166 rotates in unison, and vise versa, so that the two doors open and close in tandem when only one door is opened or closed by a user. The suction actuation gear 154 is caused to rotate by the idler gear 168 with which the actuation gear 154 engages so that as the doors are opened, the suction shaft is rotated. As such the doors provide a dual purpose. They provide support surfaces in the open position to support and guide dies, papers and cutting mats that are inserted through the die press and also cause actuation of the suction member when opened to create suction or a vacuum between a support surface and the suction member to hold the die press in place during operation.

It should be noted that the gears illustrated in FIGS. 4A and 4B are shown with smooth exterior surfaces. In reality, however, these gears include a perimeter of gear teeth for engaging with adjacent gears. Thus, while not specifically illustrated, the gears 120, 122, 130, 132, 134, 136, 154, 164, 166, 168, and 170 each have gear teeth around their perimeters for meshing with teeth on adjacent gears.

Figure 5:
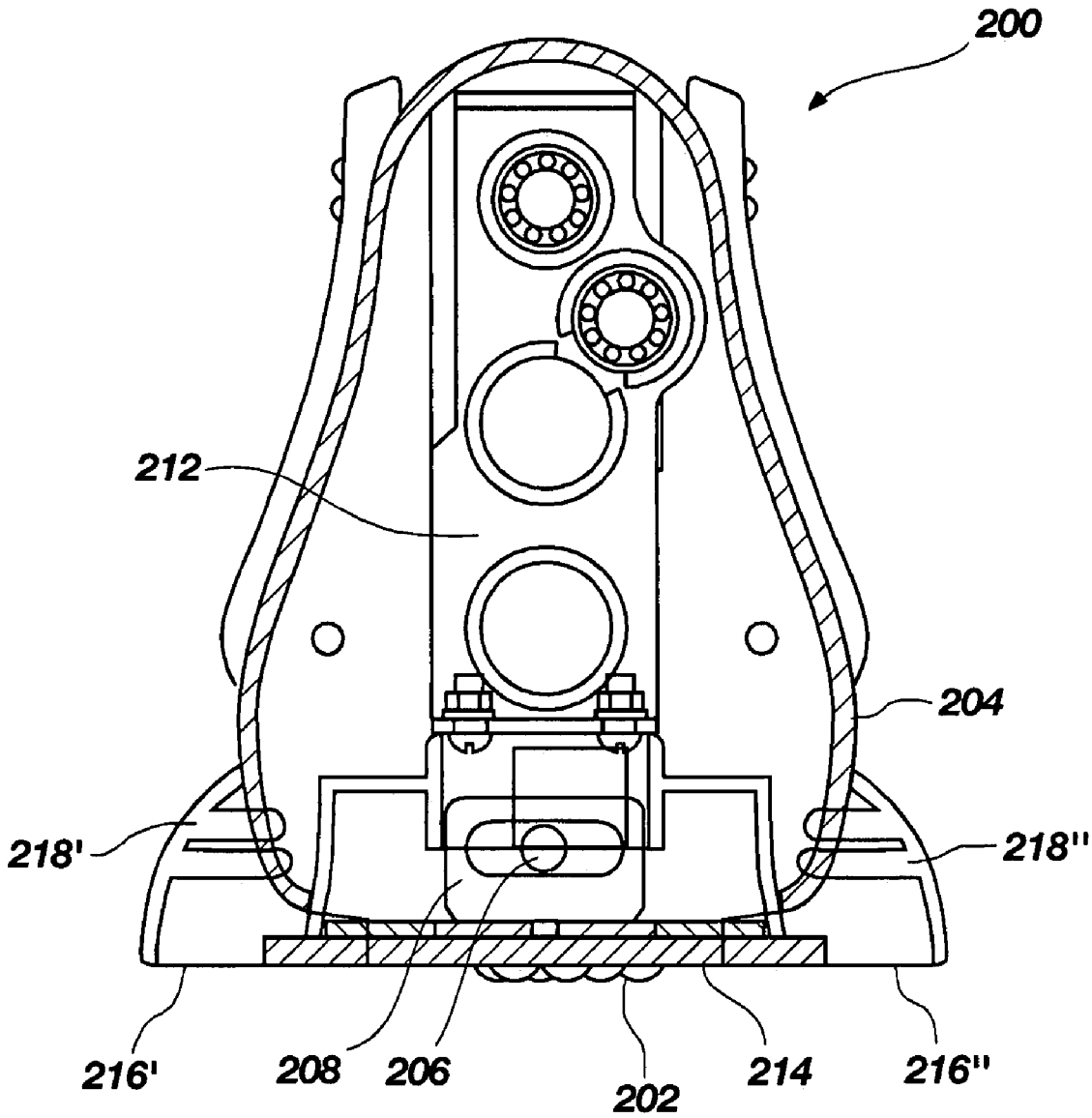
FIG. 5 is a cross-sectional side view of an alternative embodiment of a roller press in accordance with the principles of the present invention.

As shown in FIG. 5, a suction member 202 is coupled to the bottom of the roller press housing 204 of the roller press 200. The suction actuation arm 206 is coupled to the suction member with upright member 208, which is attached to the center portion of the suction member 202. Suction member support frame 210 is coupled to the roller press frame 212 such that retraction of the suction actuation arm 206 lifts the upright member 208, which in turn lifts the center of the suction member 202. The bottom surface 214 of the suction member is positioned slightly below the bottom surfaces 216' and 216" of the foot members 218' and 218", respectively.

Figure 6:
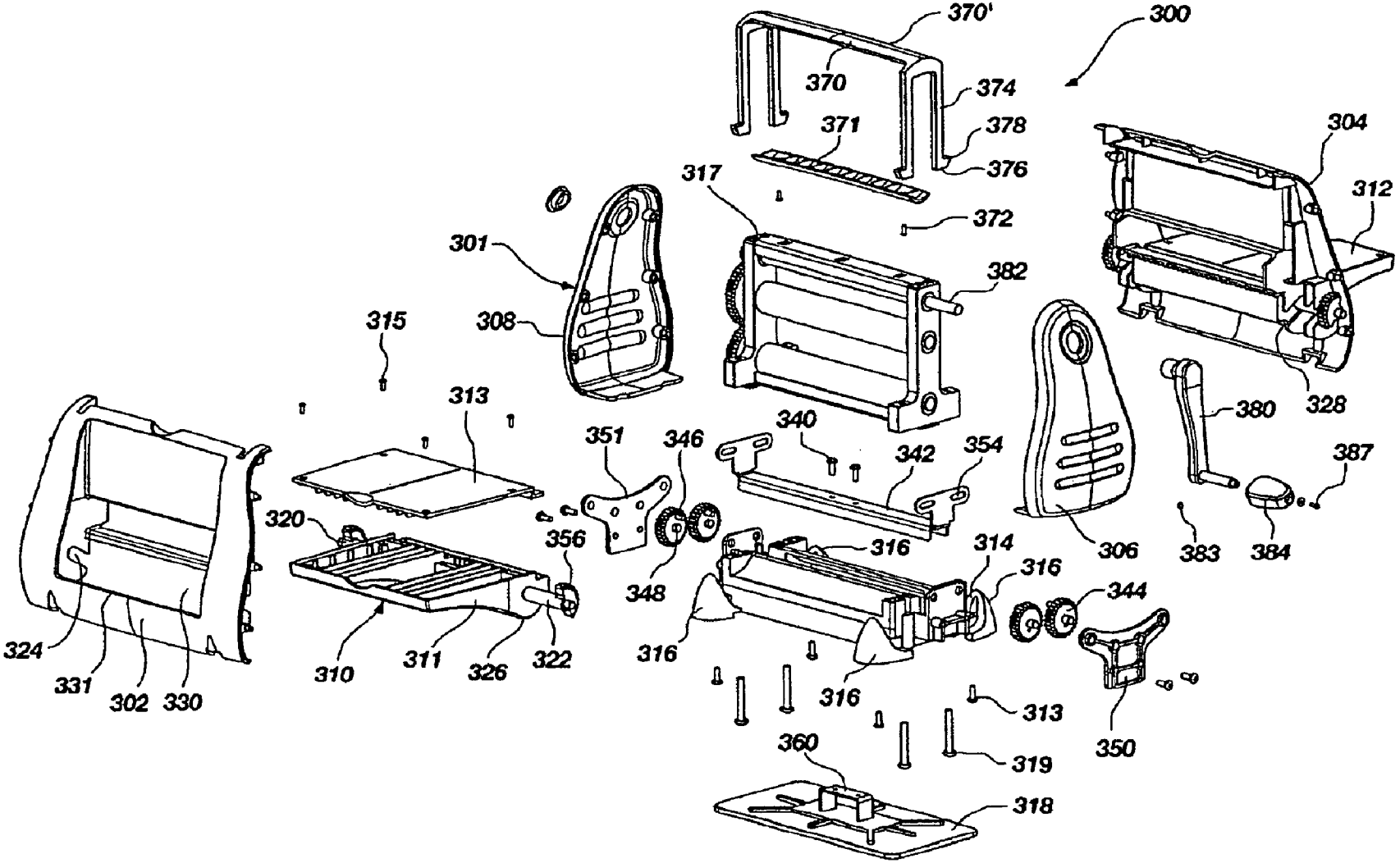
FIG. 6 is an exploded perspective view of an alternative embodiment of a roller die press in accordance with the principles of the present invention.

Referring now to FIG. 6, there is illustrated an exploded view of a roller-type die press, generally indicated at 300, in accordance with the principles of the present invention. The press 300 includes a housing, generally indicated at 301, which comprises a front portion 302, a mating back portion 304, a right side portion 306 and a left side portion 308. Each of the housing portions is held together with fasteners 319. A front door assembly 310 is comprised of an outer shell 311 and an inner door tray 313 which are fastened together with fasteners 315. The back door 312 is similarly configured. A base assembly includes a plurality of foot members 316, attached with fasteners 313, to which a suction member 318 can be actuated relative thereto as previous described. The components are fastened together to form the housing 300 which surrounds the roller press mechanism, such as the roller press mechanism, generally indicated at 317. The doors 310 and 312 are pivotally mounted with pin members 320 and 322, respectively, to corresponding pin receiving apertures or channels, only aperture 324 of which is visible, in the front and back housing members 302 and 304. The doors 310 and 312 have curved mating ends 326 and 328, respectively, that fit within corresponding recesses or openings, only opening 330 of which is visible. When the curve surface 326 fits abuts with the edge 331 of the opening 330, the door 310 is fully opened and supported by the front housing member 302 in a substantially horizontal position as shown. By providing such an abutting surface the door is fully supported by the opening 330.

The suction base 316 is attached with fasteners 340 to the suction lift bracket 342. The suction lift bracket 342 is fitted within the base assembly 314. The suction lift bracket is moveable relative to the base as by actuation with gears 344. The gears 344 have shafts or pegs 346 depending there from that are offset from the central axis or axle 348 of the gears 344. The gears 344 are rotatably coupled to the gear supports 350 and 351 which are positioned on opposite sides of the base member 314. The pegs 346 engage with apertures 354 of the suction lift bracket 342. The teeth of the gears 344 engage or mesh with the teeth on the partial gears 356 of the door assemblies 310 and 312. As either of the doors 310 and 312 is rotated, the partial gears 356 cause rotation of the associated gear 344. Rotation of the gear 344 causes vertical movement of the suction lifting bracket 342. When the doors 310 and 312 are moved from a closed position to an open position as shown, the bracket 342 is raised relative to the base 314 which causes the center bracket 360 of the suction base 318 to be lifted. Likewise, when the doors 310 and 312 are raised, the bracket 342 is lowered which lowers the center of the suction base 318 to release the base from an associated work surface.

Also illustrated in FIG. 6 is the configuration of the handle 370 which includes a cured handle portion 371 for grasping by a user. The two are held together with fasteners 372. The handle 370 includes a transverse handle portion 370' to which four legs depend. Each leg 374 has a distal end 376 provided with a laterally or transverse extending abutment 378 depending there from to allow the handle 370 to extend from the top of the housing assembly 301 a limited amount. Such an abutment 378 is provided for each leg of the handle 370.

The crank 380 is attached to the crank shaft 382 of the roller assembly 317 with fastener 383. The crank 380 includes a freely rotatable crank handle 384 coupled to the crank 380 with fasteners 387.

It is understood that the terminology used herein is used for the purpose of describing particular embodiments only and is not intended to limit the scope of the present invention. Moreover, the use of the term "sheet" herein refers to any material in sheet form that can be cut with a die and the roller press of the present invention, including without limitation papers of various thicknesses including such materials as colored papers and card stock as well as sheets of plastic, cardboard, foil or other materials known in the art. It is also understood that, as used herein and in the appended claims, the singular forms "a," "an," and "the" include plural reference, unless the context clearly dictates otherwise.

Unless defined otherwise, all technical and scientific terms used herein have the same meanings as commonly understood by one of ordinary skill in the art to which this invention belongs. While various methods, compositions, and materials of the present invention are described herein, any methods and materials similar or equivalent to those described herein may by used in the practice or testing of the present invention. All references cited herein are incorporated by reference in their entirety and for all purposes.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A roller press comprising:

a housing;

a roller assembly coupled to the housing, the roller assembly comprising a lower roller and an upper roller, wherein the lower roller and the upper roller at least partially define a passage extending through the housing, wherein the passage includes an inlet opening and an exit opening;

a crank coupled to the roller assembly;

at least one door coupled to the housing, wherein the at least one door is moveable to one of a first position and a second position, wherein the at least one door provides a means for preventing access to one or more of the inlet opening and the exit opening of the passage when the at least one door is moved to the first position, and granting access to one or more of the inlet opening and the exit opening of the passage when the at least one door is moved to the second position, wherein the at least one door provides means for supporting a die proximate one or more of the inlet opening and the exit opening of the passage when the at least one door is moved to the second position; and a suction member coupled to the housing, wherein the suction member is moveable to one of a first state and a second state upon movement of the at least one door to one of the first position and the second position, wherein the first state provides means for permitting the housing to be selectively-movable relative a support surface, wherein the second state provides means for permitting the housing to be selectively-fixed to the support surface, the suction member comprising a suction base and an actuating member coupled to the at least one door, the actuating member and the at least one door coupled together with at least one gear.

2. The roller press of claim 1, wherein said at least one door comprises a pair of doors including a first door and a second door that are interconnected by at least one pair of idler gears, wherein the at least one pair of idler gears provides means for translating movement of one of the first door and the second door when movement is initiated to the other of the first door and the second door.

3. A roller press comprising:

a housing;

a roller assembly coupled to the housing, the roller assembly comprising a lower roller and an upper roller, wherein the lower roller and the upper roller at least partially define a passage extending through the housing, wherein the passage includes an inlet opening and an exit opening;

a crank coupled to the roller assembly;

at least one door coupled to the housing, wherein the at least one door is moveable to one of a first position and a second position, wherein the at least one door provides a means for preventing access to one or more of the inlet opening and the exit opening of the passage when the at least one door is moved to the first position, and granting access to one or more of the inlet opening and the exit opening of the passage when the at least one door is moved to the second position, wherein the at least one door provides means for supporting a die proximate one or more of the inlet opening and the exit opening of the passage when the at least one door is moved to the second position, the at least one door comprising a pair of doors, each coupled to first and second gears fixedly coupled thereto, the first and second gears are positioned along the axis of pivotal rotation of the respective door; and a suction member coupled to the housing, wherein the suction member is moveable to one of a first state and a second state upon movement of the at least one door to one of the first position and the second position, wherein the first state provides means for permitting the housing to be selectively-movable relative a support surface, wherein the second state provides means for permitting the housing to be selectively-fixed to the support surface, and wherein the suction member coupled to the first and second gears of each of the pair of doors to provide means for translating rotational movement of the first and second gears to cause vertical movement of the suction member.

4. The roller press of claim 1, wherein the at least one door comprises a pair of doors, each of the pair of doors providing the die support surface proximate one of the inlet opening and the exit opening of the passage extending between the upper and lower rollers with each of the pair of doors positioned on opposite sides of the opening.

5. The roller press of claim 3, wherein the pair of doors including a first door and a second door that are interconnected by at least one pair of idler gears, wherein the at least one pair of idler gears provides means for translating movement of one of the first door and the second door when movement is initiated to the other of the first door and the second door.

6. The roller press of claim 3, wherein the suction member comprises a suction base; and an actuating member coupled to one of the doors.

7. The roller press of claim 3, wherein each of the pair of doors providing the die support surface proximate one of the inlet opening and the exit opening of the passage extending between the upper and lower rollers with each of the pair of doors positioned on opposite sides of the opening.

* * * * *